US007537141B1

(12) United States Patent
Robinson

(10) Patent No.: US 7,537,141 B1
(45) Date of Patent: May 26, 2009

(54) DISPENSING CLOSURE AND PACKAGE

(75) Inventor: Philip James Robinson, Sylvania, OH (US)

(73) Assignee: Rexam Closure Systems Inc., Perrysburg, OH (US)

( * ) Notice: Subject to any disclaimer, the term of this patent is extended or adjusted under 35 U.S.C. 154(b) by 467 days.

(21) Appl. No.: 11/189,971

(22) Filed: Jul. 26, 2005

(51) Int. Cl.
*B65D 25/40* (2006.01)

(52) U.S. Cl. ..... 222/569; 222/543; 222/566; 222/567

(58) Field of Classification Search ..... 222/543, 222/420, 566–567, 569, 590, 109; 215/11.1
See application file for complete search history.

(56) References Cited

U.S. PATENT DOCUMENTS 2,601,040 A * 6/1952 Livingstone ..... 222/109
2,743,844 A * 5/1956 Livingstone ..... 222/111
2,763,402 A * 9/1956 Livingstone ..... 222/109
2,884,151 A 4/1959 Biederman
2,907,489 A * 10/1959 Taylor, III ..... 220/258.3
2,991,913 A * 7/1961 Goth ..... 222/153.06
3,113,706 A * 12/1963 Wickman ..... 222/543
3,117,703 A * 1/1964 Henchert ..... 222/546
3,122,287 A * 2/1964 Makowski ..... 222/542
3,227,332 A * 1/1966 Gowdy et al. ..... 222/525
3,282,478 A 11/1966 Russell
3,416,688 A * 12/1968 Fanning ..... 215/306
3,468,445 A * 9/1969 Ballin ..... 215/11.6
3,493,139 A * 2/1970 Faddoul et al. ..... 215/11.1
3,495,993 A * 2/1970 Barr et al. ..... 426/117
3,833,150 A * 9/1974 Visser-Patings ..... 222/109
3,926,348 A * 12/1975 Lutzker ..... 222/189.07
4,002,275 A * 1/1977 Crowle et al. ..... 222/543
4,106,672 A * 8/1978 Tecco et al. ..... 222/151
4,124,151 A * 11/1978 Hazard ..... 222/498
4,132,225 A 1/1979 Whattam
4,498,609 A * 2/1985 Stock ..... 222/420
4,533,068 A 8/1985 Meierhoefer
4,917,271 A * 4/1990 Kanner et al. ..... 222/189.09
5,022,562 A 6/1991 Lurkis et al.
5,101,991 A * 4/1992 Morifuji et al. ..... 215/11.1
5,101,992 A * 4/1992 Serre ..... 215/11.5
5,114,374 A * 5/1992 Estiva ..... 446/77

(Continued)

FOREIGN PATENT DOCUMENTS

GB 833270 4/1960

*Primary Examiner*—Kevin P Shaver
*Assistant Examiner*—Andrew P Bainbridge
(74) *Attorney, Agent, or Firm*—Reising Ethington P.C.

(57) ABSTRACT

A dispensing closure, in accordance with one aspect of the present disclosure, includes a closure shell of plastic construction having a skirt for mounting on a container neck finish. An insert of plastic construction different from and more rigid than the shell includes a mid portion mounted to the shell, a base with the skirt for sealing engagement with a container neck finish when the closure is mounted on the neck finish, a tip extending from the mid portion and a through-passage for dispensing product from within the container. An overcap is provided for removable receipt over the tip, and preferably is of one-piece integrally molded construction with the shell and flexibly tethered to the shell. The base of the insert preferably is constructed for sealing engagement with the inside surface of the container neck finish, the end surface of the container neck finish and/or the outside edge of the container neck finish.

34 Claims, 6 Drawing Sheets

U.S. PATENT DOCUMENTS 5,154,325 A * 10/1992 Ryder et al. ..... 222/189.06
5,183,184 A * 2/1993 Ranalletta et al. ..... 222/189.09
5,320,254 A * 6/1994 Ranalletta et al. ..... 222/189.08
5,431,314 A * 7/1995 Bonnelye et al. ..... 222/420
5,588,559 A * 12/1996 Vallet Mas et al. ..... 222/92
5,685,333 A * 11/1997 Skaryd ..... 137/514.5
5,799,836 A * 9/1998 Lee ..... 222/189.07
5,863,655 A 1/1999 Mock
6,076,704 A * 6/2000 Weiler et al. ..... 222/83
6,079,589 A 6/2000 Matsuyama et al.
6,247,616 B1 * 6/2001 Weiler et al. ..... 222/83
6,415,939 B1 * 7/2002 Redmond ..... 220/266
6,485,460 B2 * 11/2002 Eakins et al. ..... 604/111
6,540,114 B1 * 4/2003 Popovich et al. ..... 222/153.02
6,805,261 B1 * 10/2004 Laudenberg ..... 222/107
6,981,966 B2 * 1/2006 Green et al. ..... 604/167.02
7,213,727 B2 * 5/2007 Kokubo ..... 222/212
2003/0160019 A1 * 8/2003 Blanding ..... 215/11.1
2003/0176530 A1 * 9/2003 Lindley et al. ..... 523/106
2003/0209570 A1 * 11/2003 Joshi et al. ..... 222/420
2008/0093396 A1 * 4/2008 Auer et al. ..... 222/569

* cited by examiner

DISPENSING CLOSURE AND PACKAGE

The present disclosure is directed to closures for dispensing fluid products from squeeze-type containers, and to packages that include such closures and containers.

BACKGROUND AND SUMMARY OF THE DISCLOSURE

Fluid dispensing closures for squeeze-type container applications typically are of one-piece integrally molded construction of relatively inexpensive plastic such as polyolefin, typically polypropylene or a polyethylene such as low density polyethylene. However, in many fluid dispensing applications, it is desirable to minimize or eliminate contact between the fluid and polyolefin material to avoid selective adsorption of materials to the polyolefin. It has been proposed in U.S. Pat. No. 3,227,332 to provide a three-piece dispensing closure that includes a shell of polystyrene, an insert of a less rigid more resilient material such as polyethylene, and a separate polyethylene overcap. The insert has a flange that extends along the undersurface of the shell for sealing engagement with the end surface of a container neck finish. However, the insert material and construction do not address or overcome the above-mentioned need in the art.

The present disclosure embodies a number of aspects that can be implemented separately from or in combination with each other.

A dispensing closure, in accordance with one aspect of the present disclosure, includes a closure shell of plastic construction having a skirt for mounting on a container neck finish. An insert of plastic construction different from and more rigid than the shell includes a mid portion mounted to the shell, a base with the skirt for sealing engagement with a container neck finish when the closure is mounted on the neck finish, a tip extending from the mid portion and a through-passage for dispensing product from within the container. An overcap is provided for removable receipt over the tip, and preferably is of one-piece integrally molded construction with the shell and flexibly tethered to the shell. The base of the insert preferably is constructed for sealing engagement with the inside surface of the container neck finish, the end surface of the container neck finish and/or the outside edge of the container neck finish.

A dispensing closure in accordance with another aspect of the disclosure includes a closure shell of plastic construction having a skirt for mounting the closure to a container neck finish. An insert of plastic construction different from the shell has a mid portion mounted to the shell, a base within the skirt for plug-sealing engagement within a container neck finish when the shell is mounted on the container neck finish, a tip extending from the mid portion of the insert and a through-passage for dispensing product from within the container. An overcap is provided for removable receipt over the tip. The insert base preferably has an upwardly concave part-toroidal flange for sealing engagement with the inside surface of the container neck finish when the closure is mounted to the container neck finish. The flange preferably has an outside diameter greater than the inside diameter of the container neck finish so that the flange is force-fit within the container neck finish as the closure is applied to the neck finish. The overcap preferably is of integrally molded construction with the closure shell and connected to the closure shell by a flexible tether. The overcap may be adapted for snap-receipt on the insert tip or on a portion of the closure shell surrounding the insert tip.

BRIEF DESCRIPTION OF THE DRAWINGS

The disclosure, together with additional objects, features, advantages and aspects thereof, will best be understood from the following description, the appended claims and the accompanying drawings, in which:

DETAILED DESCRIPTION OF PREFERRED EMBODIMENTS

Figure 1:
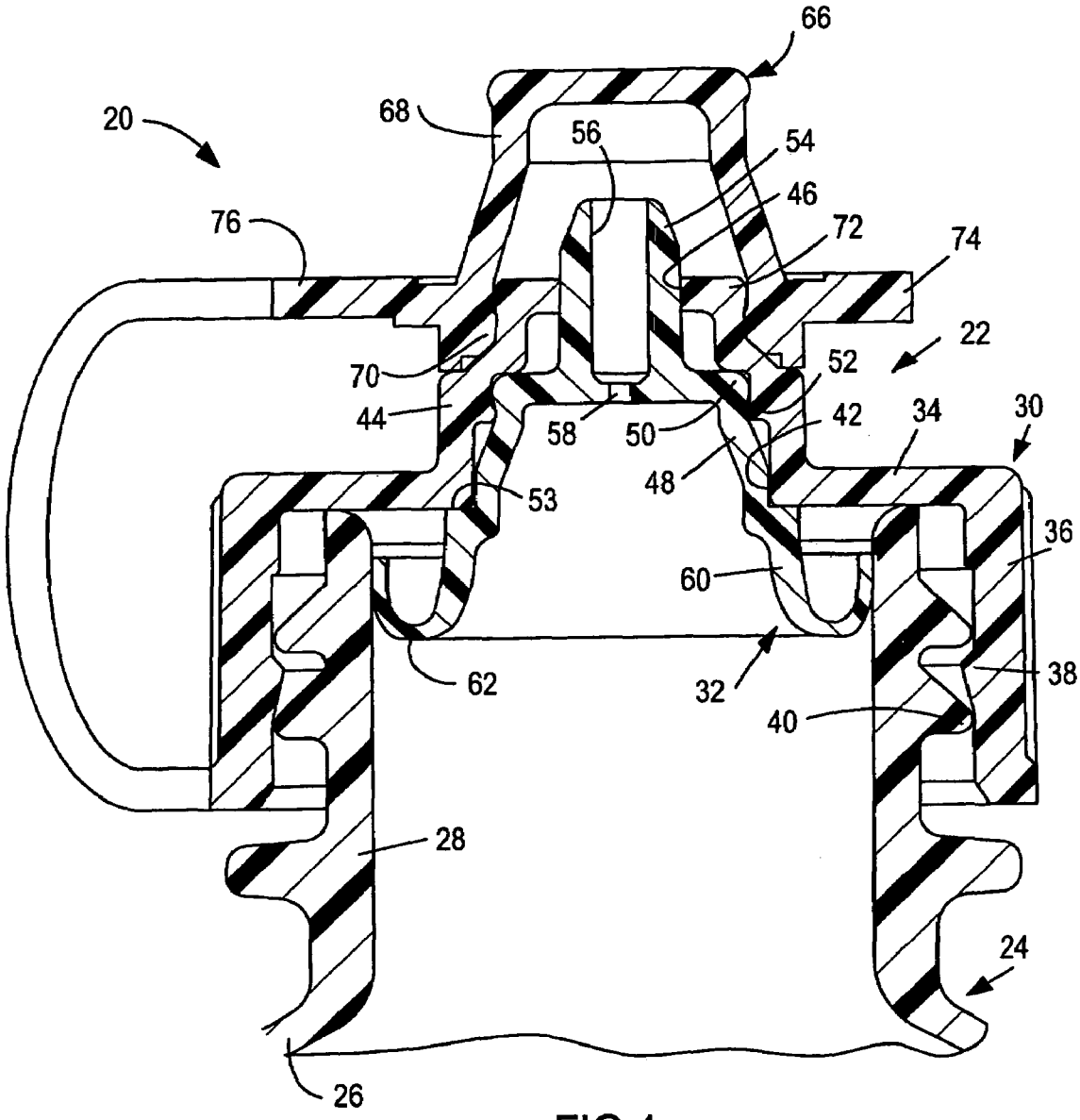
FIG. 1 is a fragmentary sectioned elevational view of a package in accordance with an exemplary embodiment of the disclosure.

FIG. 1 illustrates a package 20 in accordance with an exemplary embodiment of the disclosure as including a dispensing closure 22 mounted on a container 24. Container 24 includes a body 26 from which a neck finish 28 extends. Neck finish 28 typically would be of integrally formed construction with body 26, although this is not necessary in accordance with the present disclosure. Neck finish 28 may be coaxial with or offset from the central axis of the container body. Neck finish 28 typically is cylindrical, although this need not necessarily be the case. Container body 26 is of flexible resilient construction such as blow-molded plastic construction. By way of example only, container 24 may be of reheat or injection blow-molded monolayer or multilayer polyethylene terephthalate (PET) construction.

Dispensing closure 22 includes a closure shell 30 and an insert 32 coupled to shell 30. Shell 30 (FIGS. 1-3) preferably has a base wall 34 and a skirt 36 for securing shell 30 and closure 22 to neck finish 28 of container 24. In the illustrated embodiment, skirt 36 has one or more internal threads or beads 38 that are received over one or more external threads or beads 40 on container neck finish 28. In the illustrated exemplary embodiment of the disclosure, base wall 34 is of annular construction, having an outer periphery from which skirt 36 extends and an inner periphery that forms an opening, preferably a central opening 42. A stepped collar 44 integrally extends from the inner periphery of base wall 34 in a direction opposite from skirt 36, and has a central opening 46 spaced from base wall 34. Shell 30 may be of compression or injection molded plastic construction such as an inexpensive polyolefin—e.g., low density polyethylene.

Insert 32 preferably is of a plastic material different from, and most preferably more rigid than, that of shell 30, such as injection or compression molded PET or polycarbonate construction. Insert 32 has a mid portion 48 received within opening 42 of base wall 34. An external bead 50 is received by snap-fit over an internal bead 53 on shell collar 44 for mounting insert 32 within shell 30. Other mounting arrangements can be employed. A shoulder 52 on insert mid portion 48 preferably is in abutting engagement with the undersurface of shell base wall 34 around opening 42. A tip 54 extends from insert mid portion 48, and a through-passage 56 extends from mid portion 48 through tip 54. Tip 54 and passage 56 preferably are of cylindrical geometry. Passage 56 includes an orifice 58 in the exemplary embodiment of the disclosure to limit the quantity of fluid that is dispensed when container 24 is squeezed. Tip 54 preferably is a tight fit in opening 46 of collar 44 to limit or eliminate leakage of fluid between tip 54 and collar 44.

Figure 5:
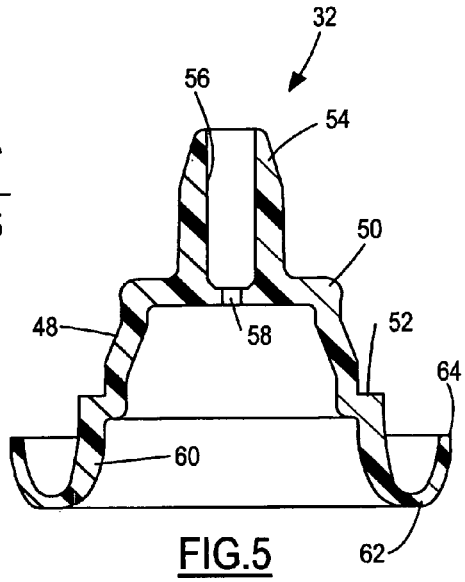
FIG. 5 is a sectional view taken substantially along the line 5-5 in FIG. 4.

Insert 32 also includes a base 60 extending from mid portion 48 within skirt 36. Base 60 in the embodiment of FIGS. 1-5 preferably includes an upwardly concave circumferentially continuous part-toroidal flange 62 that is received in plug-sealing engagement within container neck finish 28 when closure 22 is assembled to container 24. Flange 62 preferably curves continuously from base 60 to a position at least adjacent to its outer edge, although the outer perimeter of flange 62 could be conical or cylindrical. The outer diameter of flange 62 preferably is slightly greater than the inside diameter of the container neck finish so that flange 62 is press or force fit within the container neck finish as the closure is applied to the container. The curvature of flange 62 distributes the force of radially inward compression of the flange over the length of the flange. This flange design also helps ensure that the outward forces applied by the flange do not distort the container neck finish. As best seen in FIG. 5, flange 62 preferably has a sharp edge 64 at its outer diameter for digging into the inside diameter of container neck finish 28 and thereby resisting removal of insert 32 from the container neck finish.

Figure 2:
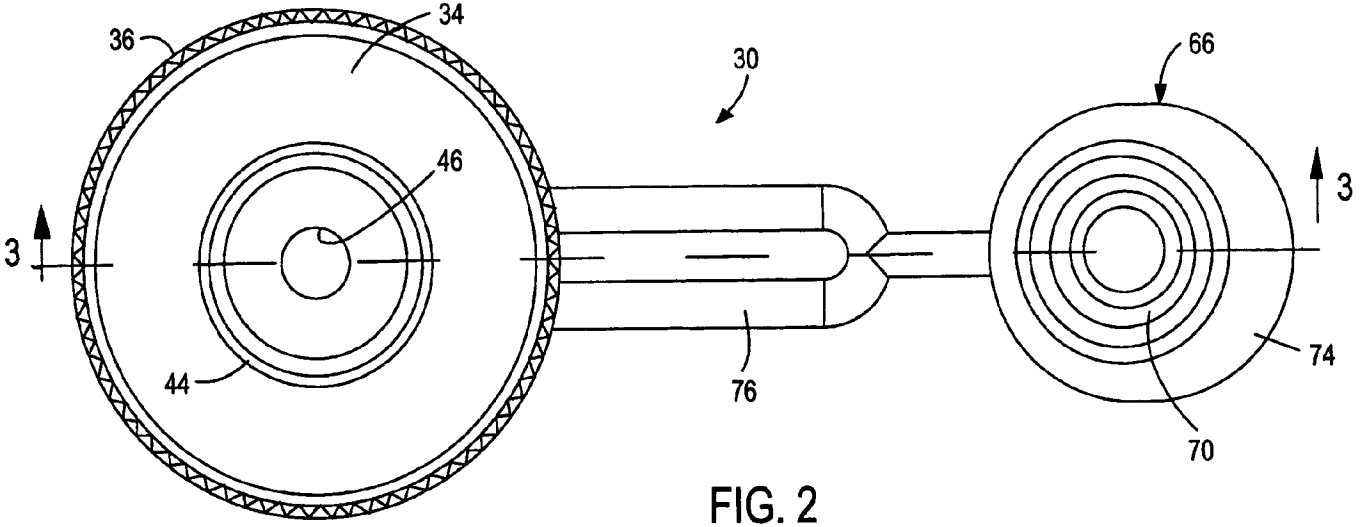
FIG. 2 is a top plan view of the shell in the dispensing closure of FIG. 1.
Figure 3:
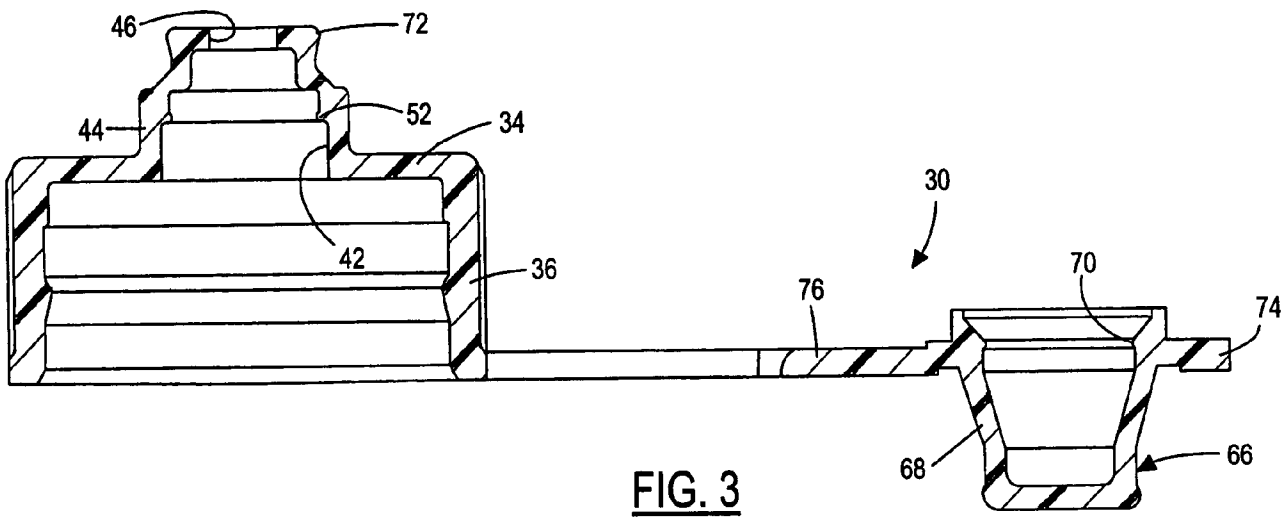
FIG. 3 is a sectional view taken substantially along the line 3-3 in FIG. 2.
Figure 4:
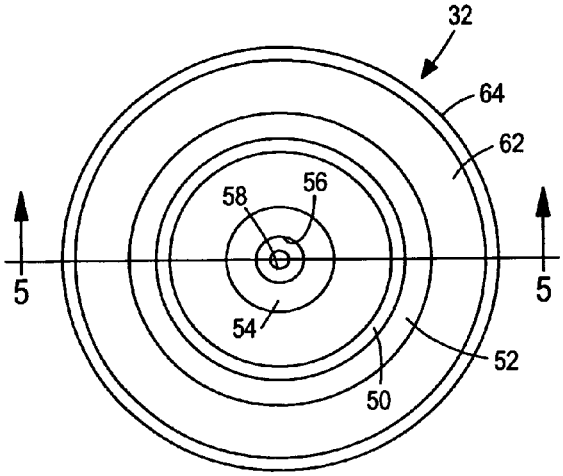
FIG. 4 is a top plan view of the insert in the dispensing closure of FIG. 1.

An overcap 66 is removably received over insert tip 54. In the embodiment of FIGS. 1-3 overcap 66 includes a cup-shaped body 68 that has an internal bead 70 for receipt by snap-fit over an external bead 72 on shell collar 44. Thus, overcap 66 does not contact tip 54 in this embodiment of the disclosure. A handle 74 on overcap 66 assists leveraged removal of overcap 66 to expose tip 54 to dispense product from within the container. Overcap 66 preferably is of one-piece integrally molded construction with shell 30 and is connected to shell 30 by an integrally molded flexible tether 76. Insert 32 may be assembled to shell 30 after molding, the insert may be insert molded into the shell, the shell may be overmolded to the insert, or the insert and shell can be molded in a two-material molding operation.

Figure 6:
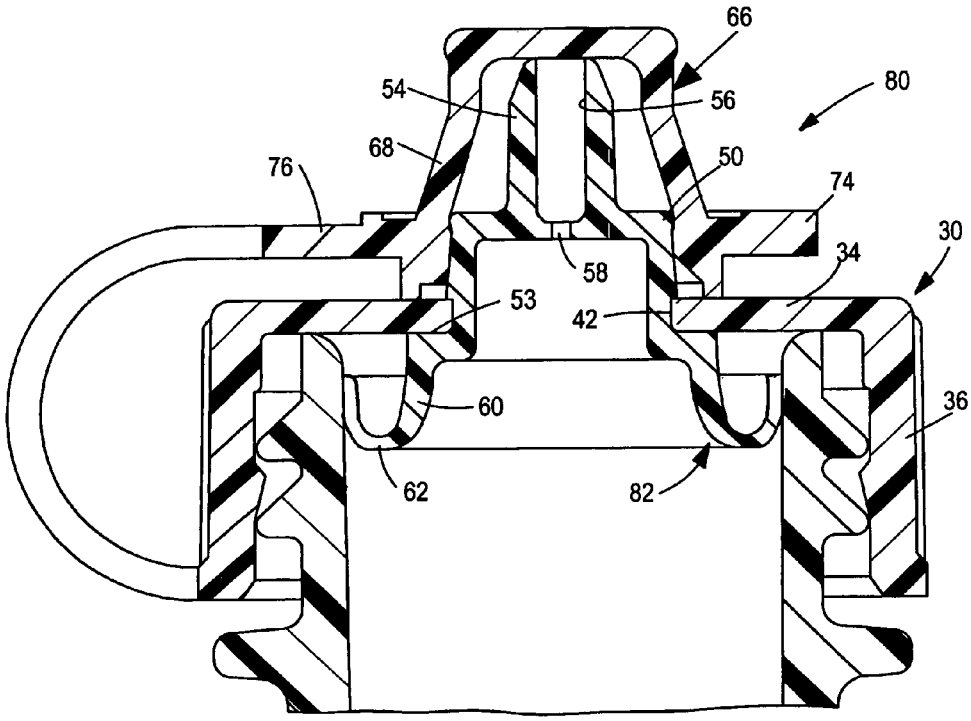
FIG. 6 is a fragmentary sectional view similar to that of FIG. 1 and illustrating another exemplary embodiment of the disclosure.
Figure 7:
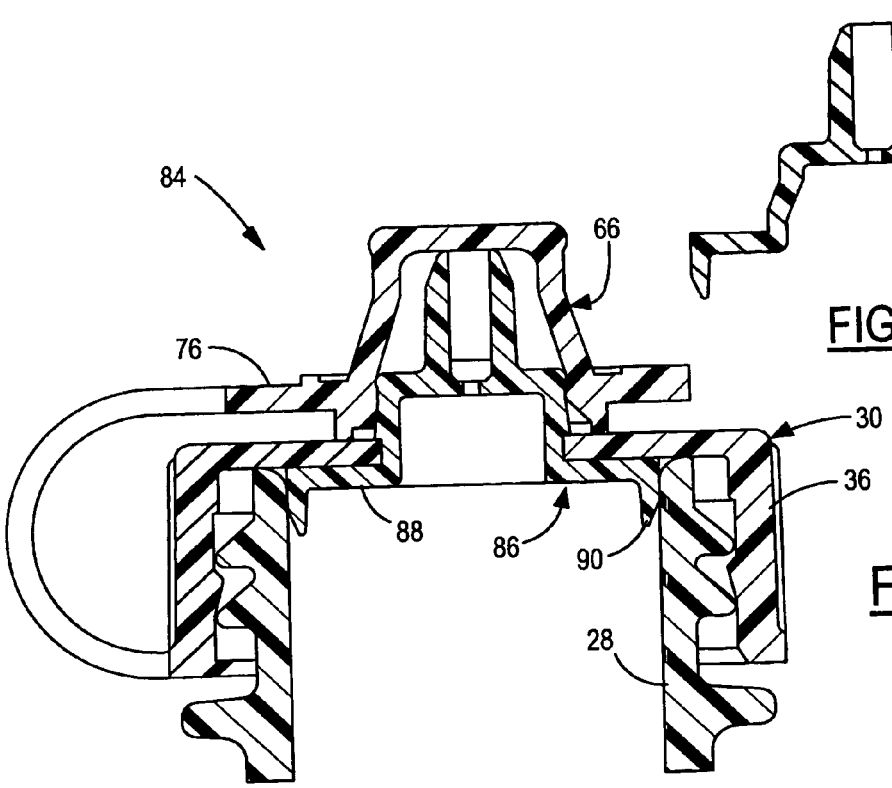
FIG. 7 is a fragmentary sectional view similar to that of FIG. 1 and illustrating a further exemplary embodiment of the disclosure.
Figure 8:
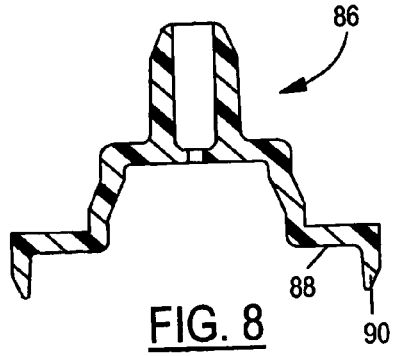
FIG. 8 is a sectional view similar to that of 5 but illustrating the insert in FIG. 7.

FIG. 6 illustrates a dispensing package 80 in accordance with a second exemplary embodiment of the present disclosure. Components of package 80 that are same as or similar to corresponding components in package 30 (FIGS. 1-5) are indicated by correspondingly identical reference numerals. The primary difference between package 80 (FIG. 6) and package 30 (FIGS. 1-5) is that overcap 66 in package 80 is received by snap-fit over bead 50 on the insert 82 rather than over a bead on the closure shell as in the embodiment of FIG. 1.

Figure 10:
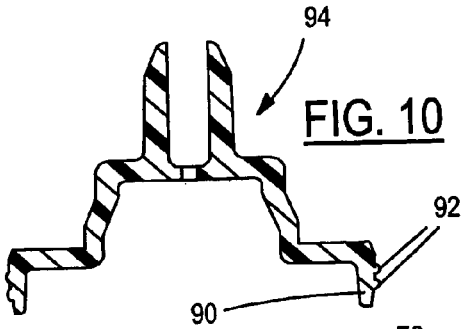
FIG. 10 is a sectional view similar to that of 5 but illustrating the insert in FIG. 9.
Figure 9:
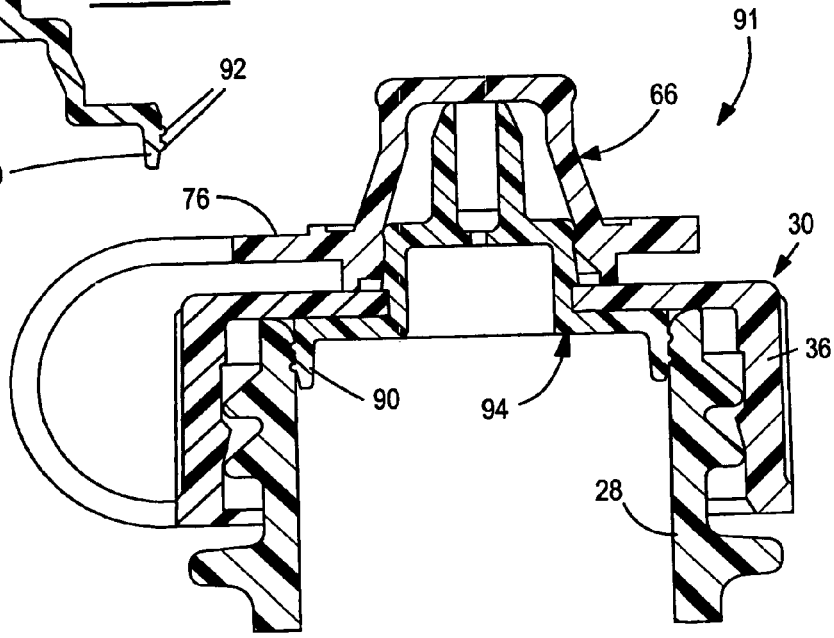
FIG. 9 is a fragmentary sectional view similar to that of FIG. 1 and illustrating another exemplary embodiment of the disclosure.

FIGS. 7-17 illustrate additional exemplary embodiments of the disclosure, in which reference numerals identical to those employed in FIGS. 1-6 indicate identical or similar components. The following discussion of FIGS. 7-17 relates to the differences between these embodiments and those already presented, which lie primarily in the sealing engagement between the insert base and the container neck finish. Package 84 in FIGS. 7-8 includes an insert 86 in which the base 88 has an annular wall 90 in sliding plug-seal engagement with the inside surface of container neck finish 28. The package 91 and insert 94 of FIGS. 9-10 are similar except that the annular wall 90 has one or more external circumferentially continuous annular beads 92 for sliding plug-sealing engagement with the inside surface of neck finish 28. Annular wall 90 preferably is substantially cylindrical or slightly outwardly flared as molded and force fit into the container mouth.

Figure 11:
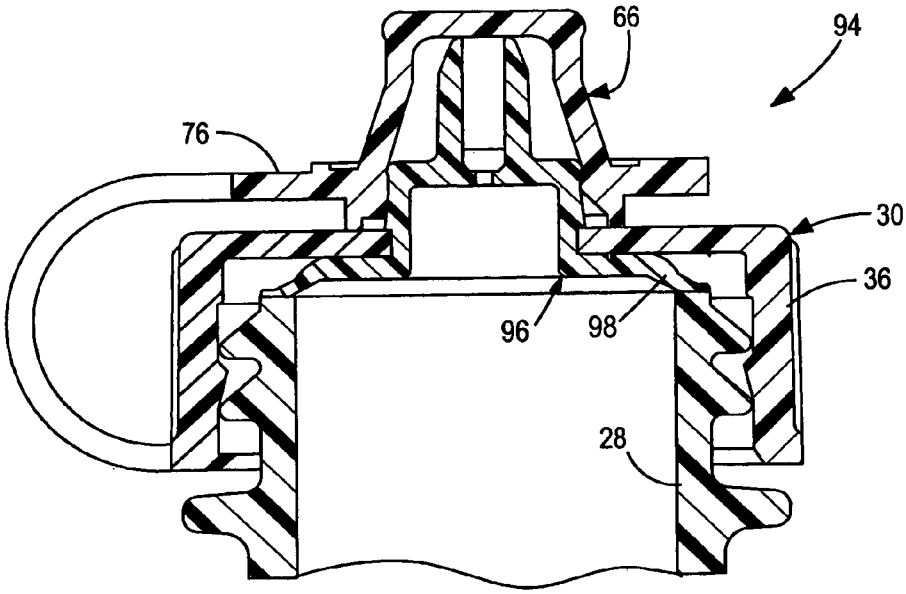
FIG. 11 is a fragmentary sectional view similar to that of FIG. 1 and illustrating another exemplary embodiment of the disclosure.
Figure 13:
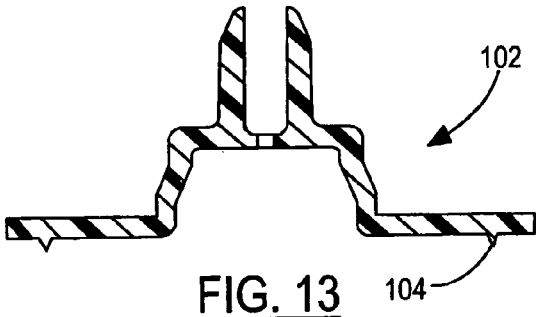
FIG. 13 is a sectional view similar to that of 5 but illustrating the insert in FIG. 12.
Figure 12:
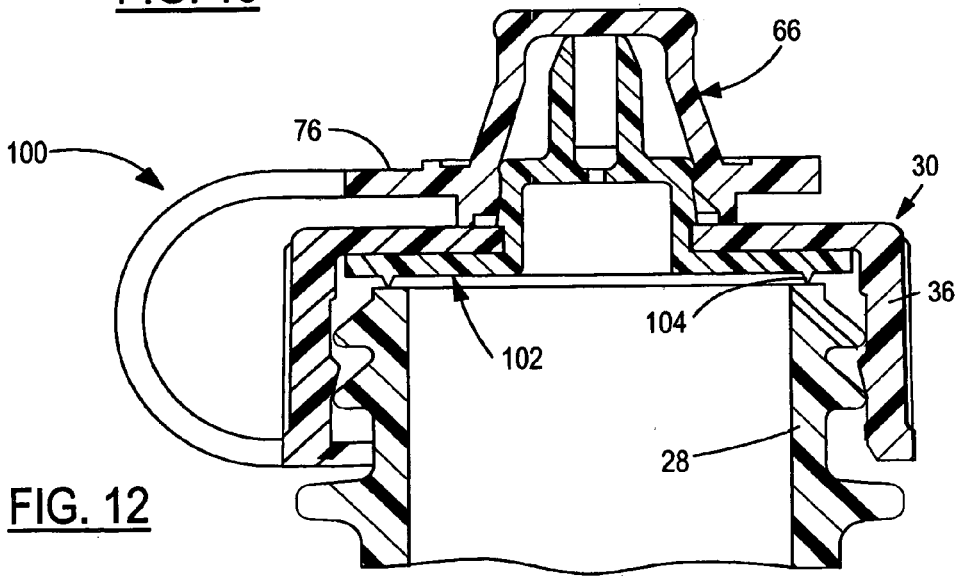
FIG. 12 is a fragmentary sectional view similar to that of FIG. 1 and illustrating yet another exemplary embodiment of the disclosure.
Figure 15:
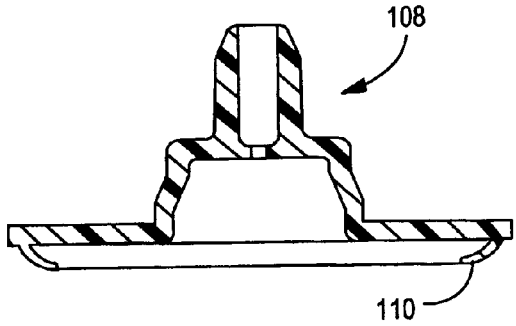
FIG. 15 is a sectional view similar to that of 5 but illustrating the insert in FIG. 14.
Figure 14:
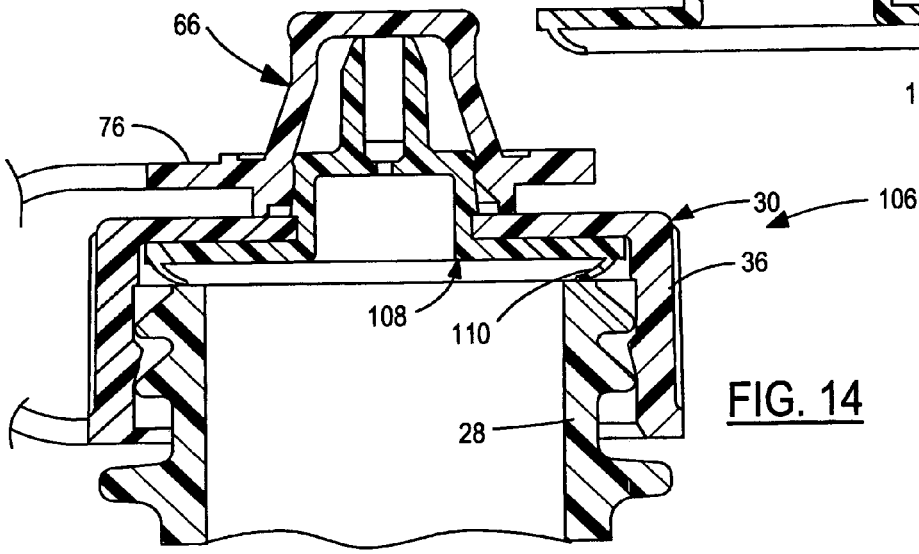
FIG. 14 is a fragmentary sectional view similar to that of FIG. 1 and illustrating another exemplary embodiment of the disclosure.
Figure 17:
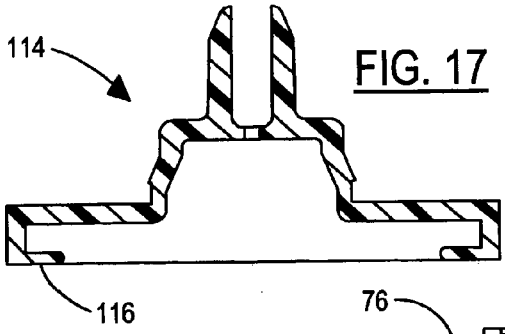
FIG. 17 is a sectional view similar to that of 5 but illustrating the insert in FIG. 16.
Figure 16:
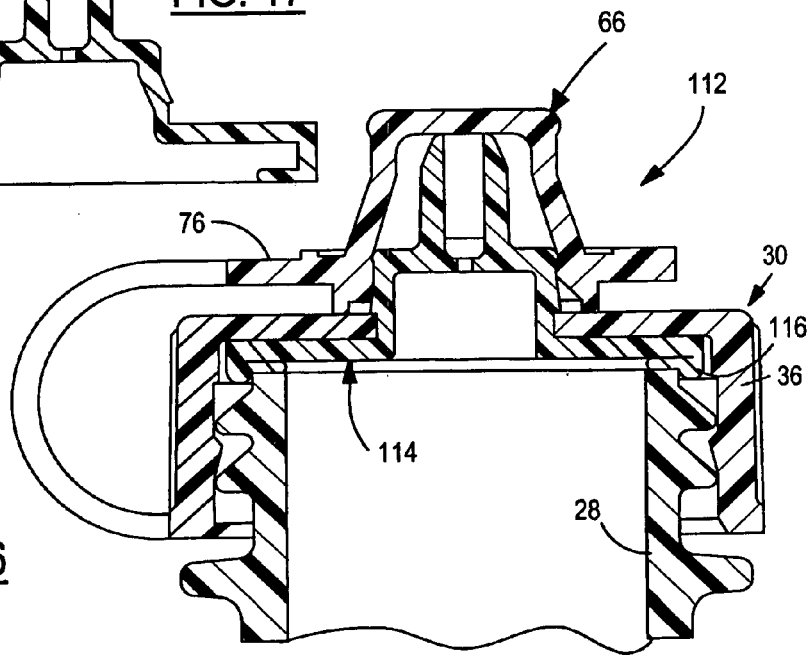
FIG. 16 is a fragmentary sectional view similar to that of FIG. 1 and illustrating a further exemplary embodiment of the disclosure.

In the packages of FIGS. 11-15, the base of the insert is constructed for sealing engagement with the end or top sealing surface of the container neck finish. In FIG. 11, insert 96 of package 94 has a base with a flexible resilient axially and radially extending annular wall 98 for sealing engagement with the neck finish. Annular wall 98 preferably tapers in thickness for enhanced differential flexure around the neck finish in the event that the neck finish end surface is cocked or warped. In the package 100 of FIG. 12, the insert 102 (FIGS. 12 and 13) has a circumferentially continuous V-shaped bead 104 for opposed sealing engagement with the neck finish end surface. In the package 106 of FIGS. 14 and 15, the insert 108 has a circumferentially continuous inwardly extending curved annular wall 110 for flexibly and resiliently engaging the end surface of container neck finish 28. Annular wall 110 preferably tapers in thickness for reasons previously discussed. The package 112 of FIGS. 16 and 17 has an insert 114 with an annular wall 116 adapted for sealing engagement with the outside edge of the container neck finish. Annular wall 116 is similar to that illustrated in U.S. Pat. No. 5,676,269, the disclosure of which is incorporated herein by reference.

There thus have been disclosed a dispensing closure and a dispensing package in which fluid dispensed from the package flows through the insert and does not contact the material of the shell. Thus, the shell may be of low density polyethylene, for example, and the insert may be of PET or polycarbonate for example and protect the fluid from contact with the shell. The disclosure has been presented in conjunction with several exemplary embodiments, and additional modifications and variations have been discussed. Other modifications and variations readily will suggest themselves to persons of ordinary skill in the art in view of the foregoing description. The disclosure is intended to embrace all such modifications and variations as fall within the spirit and broad scope of the appended claims.

The invention claimed is:

1. A dispensing closure that includes:

a closure shell of plastic construction having a base wall with an outer periphery, an inner periphery forming an opening, and an undersurface around said opening, and also having a skirt extending from the outer periphery of the base wall for mounting the closure on a container neck finish, an insert of plastic construction different from and more rigid than said closure shell, said insert having a mid portion mounted to said closure shell within said opening of said closure shell, wherein said mid portion includes a shoulder in abutting engagement with said undersurface of said base wall of said closure shell, a base within said skirt for sealing engagement with a container neck finish when said closure shell is mounted on the container neck finish, a tip extending from said mid portion, and a through-passage extending through said tip for dispensing product from within the container, and an overcap for removable receipt over said tip.

2. The closure set forth in claim 1 wherein said overcap is of one-piece integrally molded plastic construction with said shell and connected to said shell by a flexible tether.

3. The dispensing closure set forth in claim 2 wherein said base of said insert is constructed for plug-sealing engagement with an inside surface of the container neck finish.

4. The closure set forth in claim 3 wherein said base of said insert includes a flange for sealing engagement with an inside surface of the container finish when said shell is mounted to the container neck finish.

5. The closure set forth in claim 4 wherein said flange is part-toroidal and upwardly concave.

6. The closure set forth in claim 3 wherein said base has an annular wall for receipt within the container neck finish.

7. The closure set forth in claim 6 wherein said annular wall has at least one external bead.

8. The closure set forth in claim 2 wherein said base of said insert is constructed for sealing engagement with an end surface of the container neck finish.

9. The closure set forth in claim 8 wherein said base of said insert includes an angulated flexible resilient wall for sealing engagement with an end surface of the container neck finish.

10. The closure set forth in claim 8 wherein said base of said insert includes a bead for sealing engagement with an end surface of the container neck finish.

11. The closure set forth in claim 2 wherein said base of said insert includes a flexible resilient annular wall for sealing engagement with an outside edge of a container neck finish.

12. A dispensing closure that includes:

a closure shell of plastic construction having a base wall having with an outer periphery, an inner periphery forming an opening, and an undersurface around said opening, and also having a skirt extending from the outer periphery of the base wall for mounting the closure on a container neck finish, an insert of plastic construction different from and more rigid than said closure shell, said insert having a mid portion mounted to said closure shell within said opening of said closure shell, wherein said mid portion includes a shoulder in abutting engagement with said undersurface of said base wall of said closure shell, a base within said skirt for plug-sealing engagement with a container neck finish when said closure shell is mounted on the container neck finish, a tip extending from said mid portion, and a through-passage extending through said tip for dispensing product from within the container, and an overcap for removable receipt over said tip.

13. The closure set forth in claim 12 wherein said base of said insert includes a flange for sealing engagement with an inside surface of the container finish when said shell is mounted to the container neck finish.

14. The closure set forth in claim 13 wherein said flange is part-toroidal and upwardly concave.

15. The closure set forth in claim 14 for mounting on a container neck finish having a preselected inside diameter, wherein said upwardly concave part-toroidal flange has an outer diameter greater than said preselected inside diameter so that said outer diameter of said flange must be force-fit within the container neck finish.

16. The closure set forth in claim 15 wherein said outer diameter of said flange has a sharp outer edge to resist removal of said insert from the container neck finish.

17. The closure set forth in claim 12 wherein said shell and said overcap are of integrally molded plastic construction and interconnected by a tether.

18. The closure set forth in claim 12 wherein said shell has a collar within which said insert is mounted, and wherein said overcap is adapted for snap-fit onto said collar.

19. The closure set forth in claim 12 wherein said overcap is adapted for snap-fit onto said mid portion of said insert.

20. A dispensing closure that includes:

a closure shell of plastic construction having a base wall with a central opening and an undersurface around said opening, and also having a skirt for mounting the closure to a container neck finish, an insert of plastic material different from and more rigid than said closure shell, said insert having a mid portion mounted to said closure shell within said central opening of said base wall, wherein said mid portion includes a shoulder in abutting engagement with said undersurface of said base wall of said closure shell, a tip extending from said mid portion, a through-passage in said mid portion and said tip, and a part-toroidal upwardly concave flange extending from said mid portion within said skirt and having an outer diameter for plug-sealing engagement within the neck finish of a container on which said closure is mounted, and an overcap of integrally molded construction with said closure shell and connected to said closure shell by a flexible tether for removable receipt over said tip of said insert.

21. The closure set forth in claim 20 wherein said upwardly concave part-toroidal flange has an outside diameter for press-fit within the neck finish of a container when said closure is mounted on the container.

22. The closure set forth in claim 21 wherein said outer diameter of said flange has a sharp outer edge to resist removal of said insert from the container neck finish.

23. The closure set forth in claim 20 wherein said base wall has a collar within which said insert is mounted, and wherein said overcap is adapted for snap-fit onto said collar.

24. The closure set forth in claim 20 wherein said overcap is adapted for snap-fit onto said mid portion of said insert.

25. The closure set forth in claim 20 wherein said shell and said overcap are of polyolefin construction and said insert is of PET or polycarbonate construction.

26. A package that includes a container having a neck finish and a closure assembled to said neck finish, said closure including:

a closure shell of plastic construction having a base wall with an outer periphery, an inner periphery forming an opening, and an undersurface around said opening, and also having a skirt extending from the outer periphery of the base wall for mounting the closure on said container neck finish, an insert of plastic construction different from and more rigid than said closure shell, said insert having a mid portion mounted to said closure shell within said opening of said closure shell, wherein said mid portion includes a shoulder in abutting engagement with said undersurface of said base wall of said closure shell, a base in plug-sealing engagement within said container neck finish, a tip extending from said mid portion, and a through-passage extending through said tip for dispensing product from within said container, and an overcap for removable receipt over said tip.

27. The package set forth in claim 26 wherein said base of said insert includes a flange in sealing engagement with an inside surface of said container finish.

28. The package set forth in claim 27 wherein said flange is part-toroidal and upwardly concave.

29. The package set forth in claim 28 wherein said upwardly concave part-toroidal flange is force-fit within said container neck finish.

30. The package set forth in claim 29 wherein said flange has a sharp outer edge to resist removal of said insert from said container neck finish.

31. The package set forth in claim 26 wherein said shell and said overcap are of integrally molded plastic construction and interconnected by a tether.

32. The package set forth in claim 26 wherein said shell has a collar within which said insert is mounted, and wherein said overcap is adapted for snap-fit onto said collar.

33. The package set forth in claim 26 wherein said overcap is adapted for snap-fit onto said mid portion of said insert.

34. The package set forth in claim 26 wherein said shell and said overcap are of polyolefin construction and said insert is of PET or polycarbonate construction.

* * * * *